United States Patent [19]

Bakx

[11] 4,440,340

[45] Apr. 3, 1984

[54] FULLY ENCLOSED WRAP-AROUND CARTON

[75] Inventor: Martinus C. M. Bakx, Roosendaal, Netherlands

[73] Assignee: The Mead Corporation, Dayton, Ohio

[21] Appl. No.: 383,085

[22] Filed: May 28, 1982

[30] Foreign Application Priority Data

May 29, 1981 [GB] United Kingdom ..... 8116393

[51] Int. Cl.[3] ..... B65D 5/02; B65D 75/08

[52] U.S. Cl. ..... 229/40; 206/140; 206/427; 206/434

[58] Field of Search ..... 206/139, 140, 427, 434; 229/31 R, 39 R, 40, 39 B

[56] References Cited

U.S. PATENT DOCUMENTS 3,128,010 4/1964 Forrer ..... 206/140 X
3,536,248 10/1970 Odenhagen et al. ..... 229/31 R
3,705,681 12/1972 Rossi et al. ..... 229/40
4,022,372 5/1977 Graser ..... 229/40

FOREIGN PATENT DOCUMENTS 262741 10/1965 Australia ..... 229/40

*Primary Examiner*—William Price
*Assistant Examiner*—Gary E. Elkins
*Attorney, Agent, or Firm*—Erwin Doerr

[57] ABSTRACT

A fully-enclosed wrap-around carton comprising a top wall, a bottom wall, and a pair of side walls interconnecting the top and bottom walls to form a tubular structure, end closure panels hinged to opposite ends of the top and bottom walls to close, at least partially, the ends of the carton, the end closure panels which are hinged to the top wall being joined to adjacent side walls by integral web panels, characterized in that each web panel is formed from two distinct panel portions hinged together by an integral bridging element and each of the panel portions is provided with a crease line so that the web panel can be collapsed inwardly when the end closure panel is brought into a closed position.

4 Claims, 3 Drawing Figures

FULLY ENCLOSED WRAP-AROUND CARTON

This invention relates to a carton of the wrap-around type for packaging a plurality of uniform containers particularly, although not exclusively, bottles.

One aspect of the invention provides a carton of the wrap-around type comprising a top wall, a bottom wall and a pair of side walls, the side walls being hinged to the top wall and the bottom wall so as to form the tubular structure, an end closure panel hinged to the top wall panel at each end of the tubular structure to close, at least partially, the ends thereof, characterized in that each top wall end closure panel is hinged to said side wall panels by an integral web panel, said web panel comprising two panel portions hinged together by an integral bridging piece extending across an aperture defining adjacent edge parts of said two panel portions, each of said panel portions being formed with a crease line so that the web panel can be collapsed inwardly of the tubular structure when said top wall end closure panel is brought into a closed position.

An embodiment of the invention is described below, by way of example, with reference to the accompanying drawings, in which:-

Figure 1:
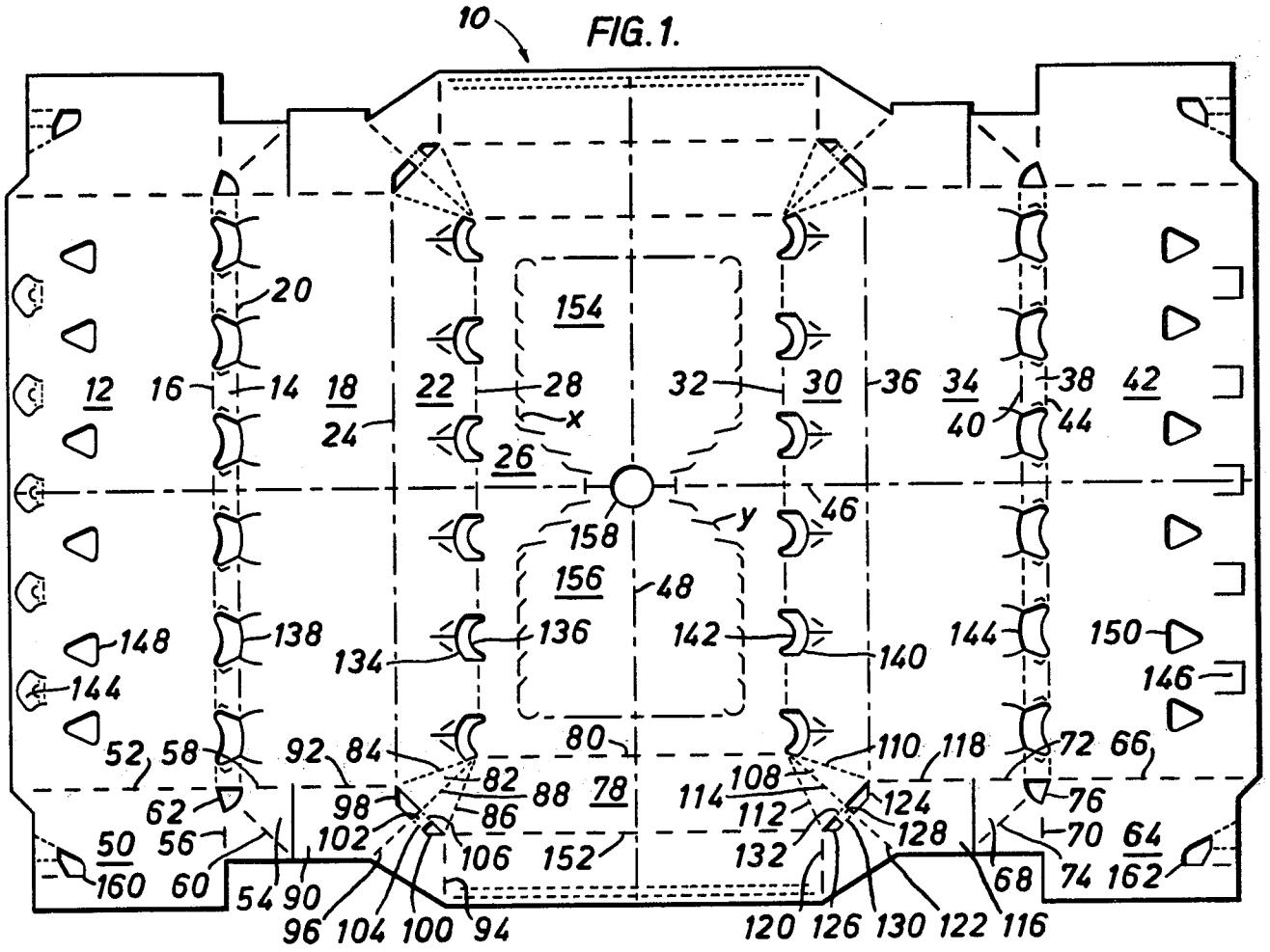
Figure 2:
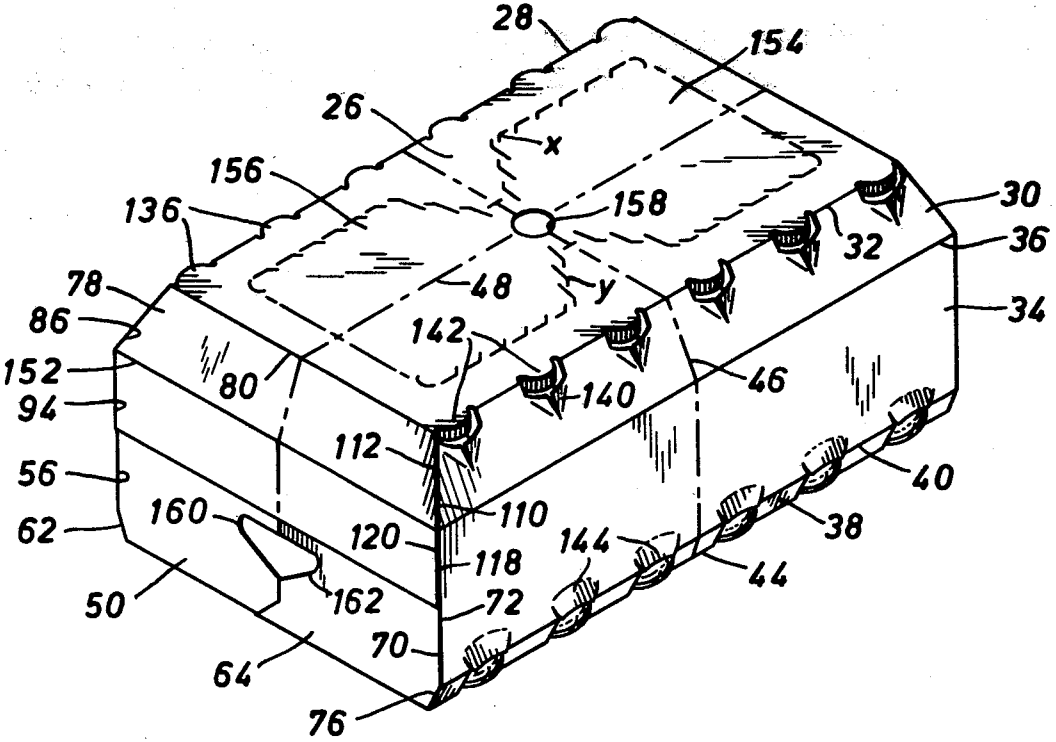
Figure 3:
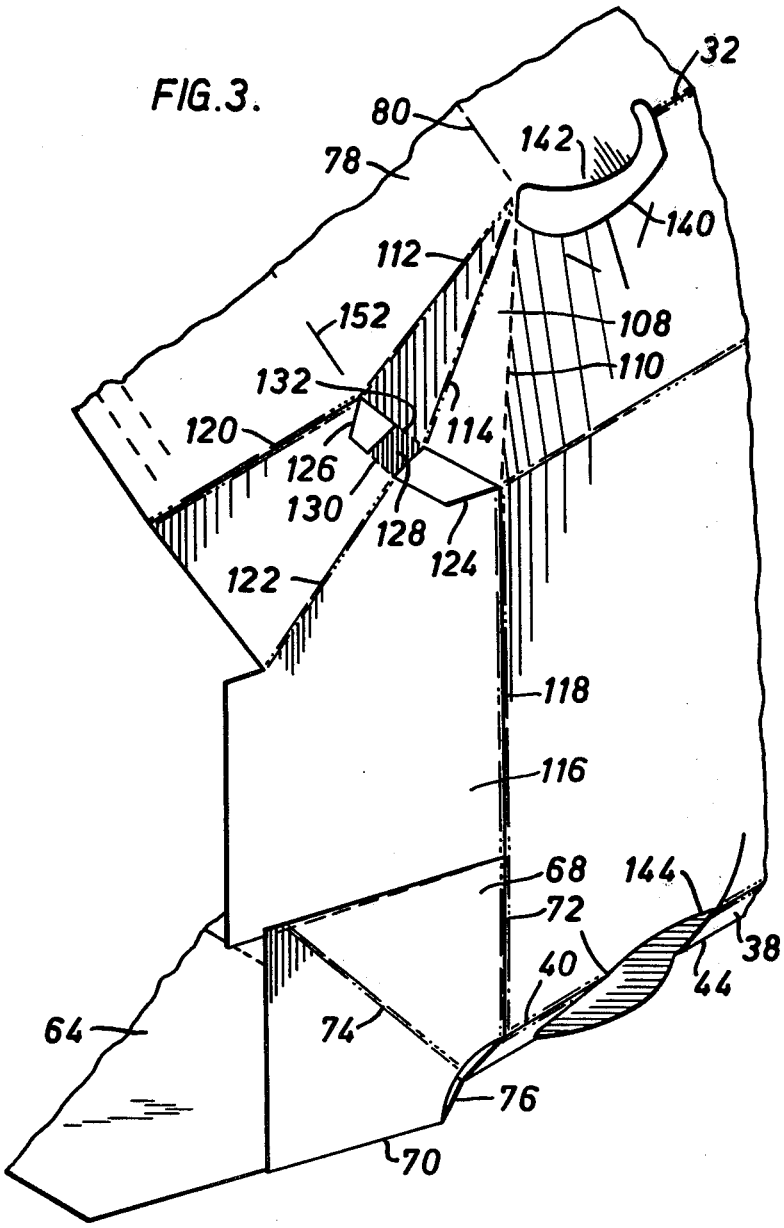

FIG. 1 is a plan view of a blank for forming of carton according to the invention, FIG. 2 is a perspective view of a carton formed from a blank as illustrated in FIG. 1 of the drawings, and FIG. 3 is a perspective view of the top right-hand corner of the carton (as viewed in FIG. 2) prior to folding of the end closure panels.

Referring to the drawings, there is shown an elongate blank 10 made from paperboard or similar foldable sheet material for forming the completed carton similar to that shown in FIG. 2 of the drawings.

The elongate blank 10 comprises, from left to right as viewed in FIG. 1, a first bottom panel 12 hinged to a lower side wall panel 14 along interrupted transverse fold line 16; a first mid side wall panel 18 hinged along one of its transverse edges to the lower side wall panel 14 along interrupted transverse fold line 20 and along its opposite transverse edge to a first upper side wall panel 22 along transverse fold line 24; and a top wall panel 26 hinged to the opposite transverse edge of upper side wall panel 22 along an interrupted transverse fold line 28. On the other side of the top wall panel 26, the blank includes a second upper side wall panel 30 hinged to opposite transverse edge of top wall panel 26 along interrupted transverse fold line 32, a second mid-side wall panel 34 hinged to the second upper side wall panel 30 along transverse fold line 36; a second lower side wall panel 38 hinged to the opposite edge of mid-side wall panel 34 along interrupted transverse fold line 40 and a second bottom panel 42 hinged along the opposite edge of second lower side wall panel 38 along an interrupted transverse fold line 44.

A central longitudinal fold line 46 extends along the blank 10 and is intersected by a central transverse fold line 48 extending across the blank 10. These fold lines facilitate folding the blank to form a 4-ply thickness of material so that the blank occupies less space for storage and distribution.

A series of end closure panels is hinged along each longitudinal edge of the blank and, in order to simplify the description, reference will now be made to those end closure panels located below the central longitudinal fold line 46, it being understood that the opposite longitudinal edge of the blank is of similar construction.

Lower end closure panel 50 is hinged to the first bottom panel 12 along a longitudinal fold line 52. A gusset panel 54 is hinged to both the lower end closure panel 50 and to the mid-side wall panel 18 along fold lines 56 and 58 respectively. Gusset panel 54 is bi-sected diagonally by fold line 60. In order to facilitate folding of the lower end closure panel 50 and the gusset panel 54 an aperture 62 is struck from the blank adjacent one corner of the gusset panel 54 such that material is removed from both the lower end closure panel 50 and gusset panel 54.

Similarly, a second lower end closure panel 64 is hinged to the second bottom panel 42 along longitudinal fold line 66. A gusset panel 68 is hinged to both the bottom end closure 64 and to the mid-side wall panel 34 along fold lines 70 and 72 respectively. Gusset panel 68 is bi-sected by a diagonally extending fold line 74. In order to facilitate folding of the lower end closure panel 64 and the gusset panel 68 an aperture 76 is struck from the blank 10 adjacent one corner of the gusset panel 68 so that material is removed from both the lower end closure panel 64 and the gusset panel 68.

A top end closure panel 78 is hinged to the top wall panel 26 along longitudinal fold line 80.

At one end of the top end closure panel 78, a gusset panel 82 is provided and which is hinged to the first upper side wall panel 22 and to one edge of the top end closure panel 78 along inclined score lines 84 and 86 respectively. Gusset panel 82 is bi-sected by inclined score line 88.

At the same end of top end closure panel 78 there is provided a side wall end closure panel 90 which is hinged to both the mid-side wall panel 18 and to the top end closure panel 78 along fold lines 92 and 94 respectively. The side end closure panel 90 is divided into two parts by an inclined fold score line 96 which is aligned with the score line 88 bi-secting gusset panel 82. The gusset panel and the side wall end closure panel together provide a web which hingedly connects each end of the top wall end closure panel with the adjacent side wall panel.

In order to facilitate folding of the top end closure panel 78 and the side end closure panel 90, panel 90 is separated from gusset panel 82 by means of apertures 98, 100 struck from the blank 10. Apertures 98 and 100 are spaced apart by means of an integral bridge 102 which is hinged to both the side end closure panel 90 and gusset panel 82 along short score lines 104 and 106 respectively.

Similarly at the opposite end of top end closure panel 78 there is provided a further gusset panel 108 which is hinged to both the upper side wall panel 30 and to the top end closure panel 78 along inclined score lines 110 and 112 respectively. Gusset panel 108 is bi-sected by inclined score line 114.

A further side wall end closure panel 116 also is provided at this end of the top wall end closure panel 78 and which is hinged to both the mid-side wall panel 34 and to the top wall end closure panel 78 along fold lines 118 and 120 respectively. The side wall end closure panel 116 is divided into two portions by means of inclined score line 122 which is aligned with the score line 114 bi-secting the gusset panel 108.

The side wall end closure panel 116 is separated from gusset panel 108 by means of apertures 124 and 126 which are struck from the blank and separated from one another by means of integral bridge 128. The integral bridge 128 is hinged to the side wall end closure panel 116 and to the gusset panel 108 along short score lines 130 and 132 respectively.

Returning now to the central portion of the blank 10, a series of generally arcuate apertures 134 is struck from the upper side wall panel 22 and are provided in order to receive neck portions of the bottles (not shown) to be packaged. Each of the apertures 134 are so formed that an outwardly projecting arcuate tab 136 is provided in order to overlie the tops of the packaged bottles. A series of bottle heel engaging apertures 138 is struck from the lower side wall panel 14 and each of the apertures 138 is aligned with a respective one of the apertures 134 so as to receive the heel portion of a bottle, as is well known in the art.

Similarly, a second series of apertures 140 is struck from upper side wall panel 30 so as to receive the neck portions of a further row of packaged bottles. Each of the apertures 140 is so formed as to provide generally arcuate tabs 142 adapted to overlie the tops of the packaged bottles received by the apertures 140. A series of bottle heel engaging apertures 144 is struck from lower side wall panel 38 each of which is aligned with one of the apertures 140 so as to receive the heel portions of the packaged bottles.

The blank illustrated is adapted to be formed into a carton for receiving four rows of bottles with each row comprising six bottles. Thus, it will be appreciated that the bottles in the outermost rows are firmly retained within the carton by means of apertures 134, 138 and 140, 144.

In order to form and fill the completed carton, the blank 10 normally is applied to a continuously moving group of bottles disposed in four parallel rows. Hence, the top wall panel 26 is brought into contact with the tops of the bottle group and the blank then folded about fold lines 28 and 32 in order to bring the side wall 14, 18, 22 and 30, 34, 38 into a position generally normal of the top wall panel 26 whereby the neck portions of the outer rows of bottles are received in apertures 134 and 140.

The blank is further folded about fold lines 16, 20 and 40, 44 so as to bring the bottom panels 12 and 42 into overlapping relationship with respect to the bases of the bottle group to be packaged.

Bottom panel 12 is provided with a series of known male locking elements 144 which are disposed adjacent the free edge of panel 12. Similarly, bottom panel 42 is formed with a series of retaining locking tabs 146 defining locking apertures disposed adjacent the free edge of panel 42. A series of generally triangular apertures 148 are struck from bottom panel 12 inwardly of locking tabs 144 and a similar series of generally triangular apertures 150 are struck from the bottom panel 42 inwardly of locking tabs 146.

In order to form and maintain the carton blank into a tubular configuration the series of apertures 148 and 150 are engaged by cooperating machine elements which draw bottom panels 12 and 42 toward one another thus tightening the blank about the group of bottles to be packaged. When the appropriate tightness has been achieved and with the bottom panel 12 overlapped externally of bottom panel 42 locking elements 144 are thrust upwardly into the apertures defined by retaining tabs 146 in order to lock together bottom panels 12 and 42 as is well known in the art. This procedure will also result in locating the heel portions of the bottles in the outermost rows in respective ones of the apertures 138 and 144.

In order to close the ends of the tubular structure thus formed, suitable machine components wipe against the gusset panel 82 and/or side wall end closure panel 90 and also against gusset panel 108 and/or side wall end closure panel 116 in order to initiate folding of the top wall end closure panel 78 downwardly about fold line 80. As this folding process continues, gusset panel 82 is displaced inwardly by folding about fold lines 84 and 86 so that the portions thereof on either side of the central fold line 88 are brought into face contacting relationship with respect to one another. Also side wall end closure panel 90 folds inwardly about fold lines 92 and 94 so that the portions thereof on either side of inclined score line 96 are brought into face contacting relationship with respect to one another. In so doing the integral bridging 102 also is displaced inwardly and upwardly about fold lines 104 and 106. As will be apparent, the displacement of the integral bridge transmits the inward collapsing movement between the gusset panel 82 and the side wall end closure panel 90 so hat the collapsing movement of these panels occurs substantially simultaneously. It will be appreciated that this facilitates the folding operation and ensures proper and even closing of the top end closure panel.

In a similar manner the portions of gusset panel 108 on either side of central score line 114 are brought into face contacting relationship with respect to one another as are the portions of side wall end closure panel 116 disposed on opposite sides of score line 122.

In order to allow the carton better to conform to the shape of the packaged bottles the relative dimensions of the panels are chosen so that the upper side wall panels 22 and 30 slope inwardly towards the top wall of the carton and the lower side wall panels 14 and 38 slope inwardly towards their respective bottom panels 12 and 42 for a similar reason the top wall end closure flap 78 is formed with a further fold line 152 extending across that panel parallel to and spaced outwardly of fold line 80. The position of fold line 152 is such that the opposite ends thereof meet with apertures 100 and 126 respectively. As shown the hinged connection 80 between the top wall end closure panel 78 and top wall panel 26 extends between the outermost apertures in each of the series 134 and 140 so that the fold line 80 is spaced inwardly of and parallel to the longitudinal edge of the main panels of the blank defined by fold lines 52, 58, 92 and 118, 72 and 66 as seen in FIG. 1 of the drawings.

In order to complete the end closure of this tubular structure to form the completed carton an application of adhesive is applied adjacent to the lowermost edge of top end closure flap 78. Following this, suitable machine elements wipe across gusset panels 54 and 68 in order to displace gusset panels 64, 68 inwardly about fold lines 56, 58 and 70, 72 respectively. This folding operation initiates the upward folding of bottom end closure panels 50 and 64 about fold lines 52 and 66 respectively. As folding continues the portions of gusset panel 54 on either side of the score line 60 are brought into face contacting relationship with respect to one another and similarly the portions of gusset panel 68 on either side of the inclined fold line 74 are brought into face contacting relationship with respect to one another. Thus, the bottom end closure panels 50 and 64 are brought into overlapping relationship with respect to the top end closure panel 78 and adhered thereto in order to complete the end closure of the package.

In order to gain access to the contents of the package a pair of readily tearable panels 154 and 156 are provided in top wall panel 26 and defined by a series of scored nicks "x" and "y". To facilitate grasping the panels 154 and 156 in order to commence tearing, a central aperture 158 is struck from the top wall panel 26.

In order to provide for portage of the loaded carton, each of the bottom end closure panels 50 and 64 is formed with finger gripping apertures 160 and 162 respectively. The apertures 160 and 162 are located in the bottom end closure panels 50 and 64 so that they are brought into side-by-side register with one another when the end closure of the carton is completed. Cushioning flaps 164 and 166 are hinged across the space defining the apertures 160 and 162 respectively and which may be displaced readily in order to grasp the carton.

I claim:

1. A carton of the wrap-around type comprising a top wall (26), a bottom wall (12, 42), and a pair of side walls (18, 22: 30, 34), the side walls being hinged to the top wall and the bottom wall so as to form a tubular structure, and an end closure panel hinged to the top wall panel at each end of the tubular structure to close, at least partially, the ends thereof, characterized in that each top wall end closure panel is hinged to said side wall panels by an integral web comprising a gusset panel (82, 108) and a side wall end closure panel (90, 108) both of which are hinged to respective ends of said top wall end closure panel and the adjacent side wall panels and further are hinged to one another by an integral bridge (102,128) extending across an aperture (98, 100: 124, 126) defining adjacent edge parts of said gusset panel and said side wall end closure panel, each of said gusset panel and said side wall end closure panel being formed with a crease line (88, 96: 114, 122) so that they can be collapsed inwardly of the tubular structure thereby to bring the top wall end closure panel into a closed position, said bridge being displaced inwardly and upwardly to transmit the collapsing movement between said gusset panel and said side wall end closure panel.

2. A carton according to claim 1 further characterized in that said side wall end closure panel includes an intermediate fold line which is aligned with an intermediate fold line of said gusset panel to form a continuous crease line (114, 122) extending from a corner of said top wall to a peripheral edge of said side wall end closure panel.

3. A carton according to claim 2 further characterized in that said continuous crease line extends across said bridging piece.

4. An elongate blank for forming a carton of the wrap-around type, which blank comprises a first bottom wall panel (12), a first side wall panel (18,22), a top wall panel (26), a second side wall panel (30,34), and a second bottom wall panel (42), hinged one to the next along transverse fold lines so that the blank can be folded into a tubular structure, each of said bottom, top and side wall panels having an end closure panel hinged thereto along each of its longitudinal edges for closing the ends of the tubular structure, characterized in that each top wall end closure panel is hinged at each of its ends to an adjacent side wall panel by a web panel structure comprising a side wall end closure panel (116) and a gusset panel (108) which panels have adjacent edges spaced a part by an aperture (124,126) struck from the blank and hinged together by a bridging piece (128) spanning the aperture.

* * * * *